US005975977A

United States Patent [19]

Choi

[11] Patent Number: 5,975,977

[45] Date of Patent: Nov. 2, 1999

[54] TOY BUILDING CONSTRUCTION KIT

[75] Inventor: Kei-Fung Choi, Chai Wan, The Hong Kong Special Administrative Region of the People's Republic of China

[73] Assignee: Silverlit Technology Ltd, Virgin Islands (Br.)

[21] Appl. No.: 08/843,618

[22] Filed: Apr. 10, 1997

Related U.S. Application Data

[62] Division of application No. 08/406,590, Mar. 20, 1995, Pat. No. 5,681,201.

[51] Int. Cl.[6] ..... A63H 33/12; A63H 33/06; A63H 33/08; A63H 3/52

[52] U.S. Cl. ..... 446/105; 446/121; 446/127; 446/476

[58] Field of Search ..... 446/105, 107, 446/108, 110, 115, 116, 118, 120, 121, 127, 476, 478

[56] References Cited

U.S. PATENT DOCUMENTS

| | | | |
|---|---|---|---|
| 2,523,508 | 9/1950 | Ledgett | 446/110 X |
| 2,968,118 | 1/1961 | Paulson | 446/105 |
| 3,168,793 | 2/1965 | Gibson | 446/127 |
| 4,007,555 | 2/1977 | Sasoka | 46/127 |
| 4,833,856 | 5/1989 | Zwagerman | 446/127 X |
| 4,895,548 | 1/1990 | Holland et al. | 446/476 |
| 5,421,762 | 6/1995 | Glickman | 446/124 X |

FOREIGN PATENT DOCUMENTS

| | | | |
|---|---|---|---|
| 1113404 | 8/1961 | Germany | 446/105 |
| 1805769 | 8/1970 | Germany | 446/127 |
| 3620379 | 12/1987 | Germany | 446/127 |
| 920030 | 3/1963 | United Kingdom | 446/116 |

*Primary Examiner*—D. Neal Muir
*Attorney, Agent, or Firm*—Burns, Doane, Swecker & Mathis, L.L.P.

[57] ABSTRACT

A toy building construction kit includes a plurality of floor defining elements, connectors for interconnecting the floor defining elements, a plurality of support pillar elements for interconnecting adjacent floors, and partition elements adapted to be received between the support pillar elements to define walls. A particularly rigid interconnection of the floor defining elements is achievd by using connecting elements and an arrangement of connecting lugs and recesses. The connecting lugs are T-shaped and fit tightly within corresponding recesses.

8 Claims, 15 Drawing Sheets

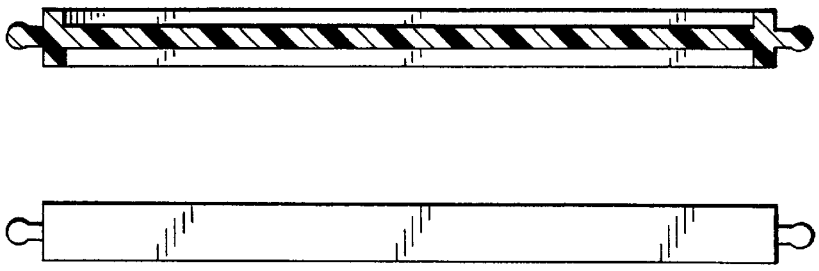
FIG. 30
FIG. 31
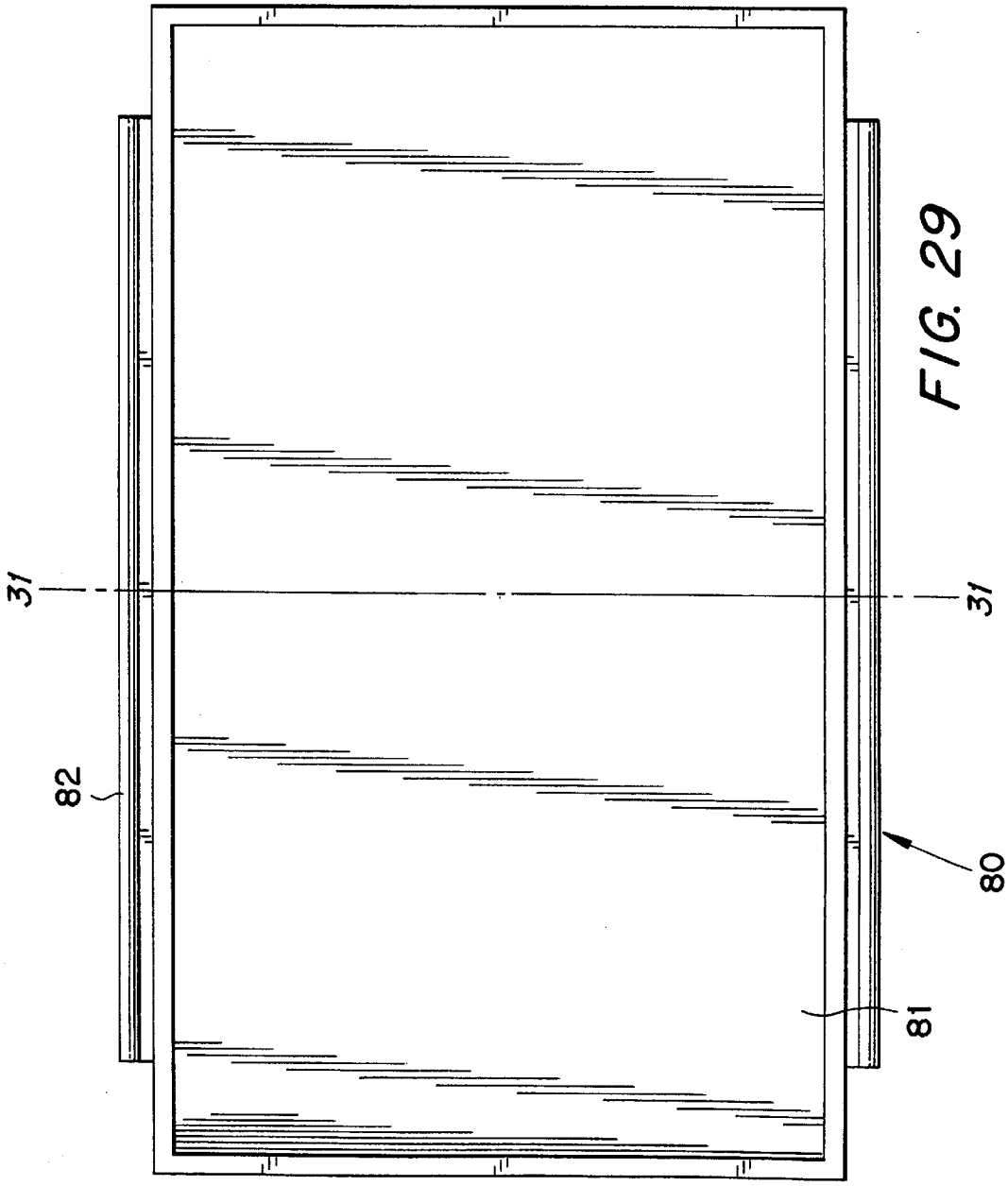
FIG. 29

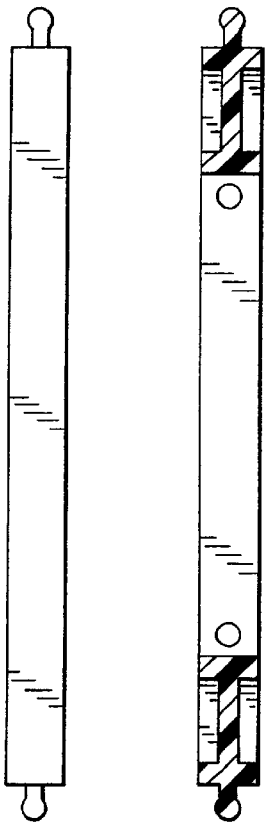
FIG. 33
FIG. 34
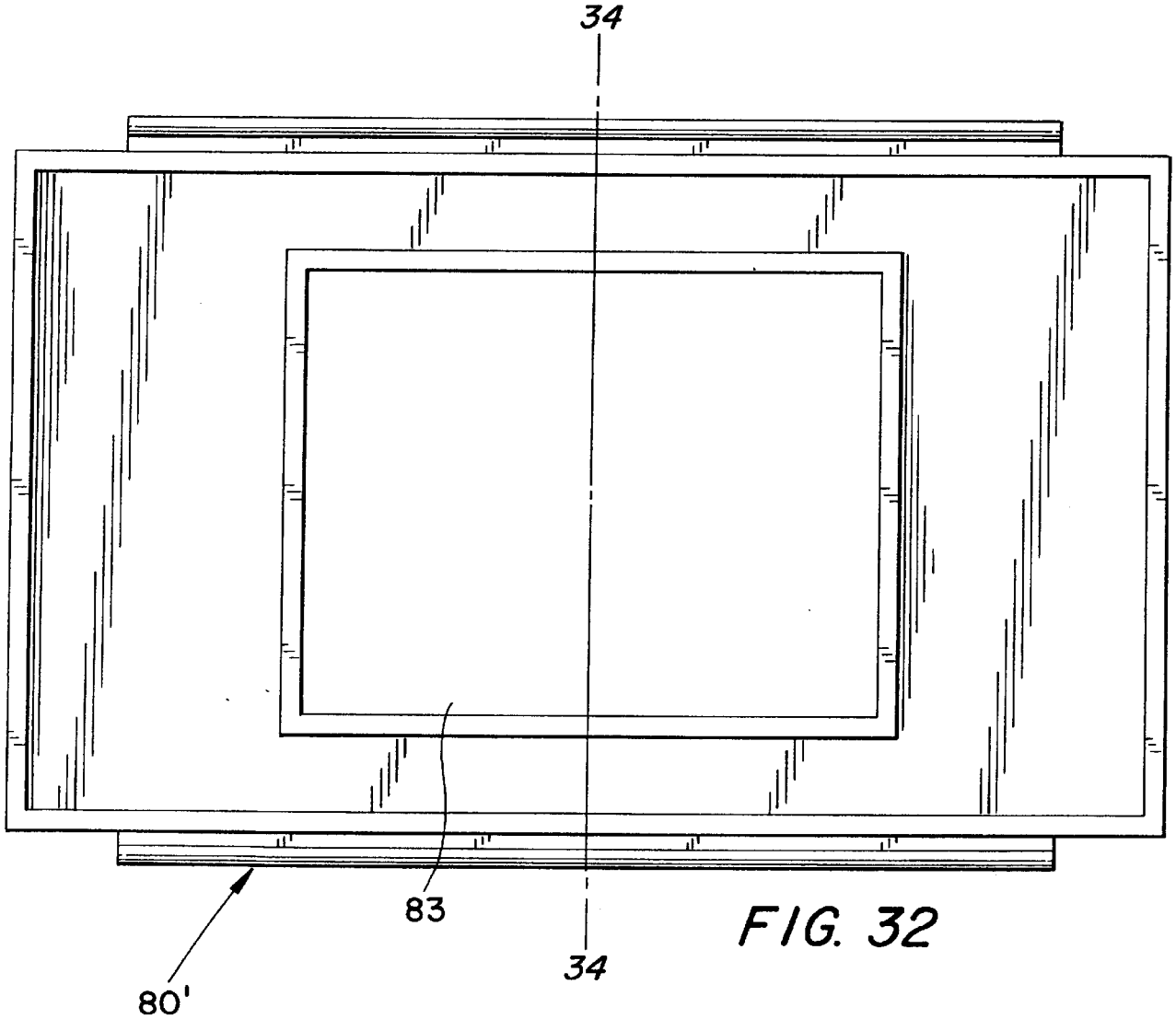
FIG. 32

TOY BUILDING CONSTRUCTION KIT

This application is a divisional, of application Ser. No. 08/406,590, filed Mar. 20, 1995, now U.S. Pat. No. 5,681, 201.

FIELD OF THE INVENTION

This invention relates to a toy building system, and in particular to such a system adapted to allow a child to construct model buildings of a wide variety of sizes and designs.

BACKGROUND OF THE INVENTION

Many different types of toy construction kit are known and have become widespread and popular over the years. Such kits usually comprise a number of standard elements or building blocks together with means for connecting such elements or building blocks together in order to create large-scale structures. The connection means may comprise a seperate connection element or it may be formed integrally on the building block, for example in the form of connecting lugs or projections that are engageable with complementary recesses.

Such construction kits have become very popular with children over the years. Another popular and very traditional type of toy is a toy building. This may take various forms ranging from dolls houses to toy garages that a child may play with together with a set of toy cars. A disadvantage of such toy buildings, however, is that generally speaking they are fixed in design and cannot be changed. This means that a child can often become bored with them after a period of time. It would be desirable therefore to be able to combine the concepts of a construction toy such that a child may be able to produce toy buildings of his or her own design.

PRIOR ART

As previously discussed many different types of toy construction systems are known. The very popular Lego (Registered Trade Mark) system being perhaps the best known example. Although such systems can be used to construct buildings they are not especially designed for this purpose and the resulting buildings do not look very realistic. The difficulty is that to construct a realistic building of several storeys the floor at each storey must be relatively thin compared to its total surface area. When such a floor is to be constructed of a number of modular elements this presents difficulty in providing adequate strength to the structure.

For example there exists a known construction kit described in U.S. Pat. No. 4,519,724 which comprises a plurality of relatively large (compared to their thickness) surface area components that can be connected together. This construction kit is not designed to create buildings but instead is intended for a child to produce street layouts, with the construction elements forming sidewalks. For its purpose the connection means between the elements is adequate, they are in any event placed on a flat surface that will support them, but the connections between the elements do not provide sufficient strength for this toy kit to be adapted to generate buildings, particularly multi-storey buildings. Indeed it is an object of the system forming the subject matter of U.S. Pat. No. 4,519,724 that the elements be connected together in a flexible manner.

SUMMARY OF THE INVENTION

According to the present invention there is provided a toy building construction kit, comprising;

(a) a plurality of generally planar modular floor defining elements;

(b) means for interconnecting said floor defining elements to create a floor;

(c) a plurality of support pillar elements adapted to be secured between two adjacent floors; and (d) a plurality of partition elements, said partition elements being adapted to be received between pairs of said support pillar elements to define walls.

In a preferred embodiment the means for interconnecting said floor defining elements comprises a plurality of connecting elements, said connecting elements being provided with connecting lugs adapted to be received in corresponding connecting recesses provided on said floor defining elements. Preferably at least some of said connecting elements are provided with both connecting lugs and with corresponding connecting recesses.

In a particularly preferred embodiment there are provided two types of connecting elements, generally square first-type connecting elements each side of which is formed with a connecting lug thereon, and generally rectangular second-type connecting elements the ends of which are formed with connecting recesses and the sides of which are formed with connecting lugs. With such an arrangement a rectangular lattice of the second-type of connecting elements may be constructed with the second-type elements being interconnected at junctions by the first-type connecting elements. The squares thus defined by this rectangular lattice may be occupied by said floor defining elements.

There may also be various types of floor defining elements. The first and most important type is a square element having connecting recesses formed in each of its four sides. Other types of floor defining elements are also possible, however, and in particular other types of floor defining elements may be necessary to define a side of the floor. For example there may be triangular floor defining elements in which two sides are provided with connecting recesses and the third side is not so provided, and there may be circular segment floor defining elements having two straight sides formed with connecting recesses and and an arcuate side not so provided.

The support pillar elements preferably comprise generally cylindrical elements of polygonal cross-section and provided with a recess in each surface of the element, with the dimensions of the recesses and the spacing between adjacent recesses being such that the edges of said partition elements may be received within said recesses whereby said partition elements may be securely held in place.

Preferably the ends of said cylindrical support pillar elements are provided with connecting means whereby said support pillar elements may connect with corresponding connecting portions formed on said floor defining elements and also formed on said connecting elements. In a particularly preferred embodiment one end of said support pillar elements is formed with a first-type of connecting means adapted to engage with a corresponding first-type of connecting portion that is formed on an underside of said floor defining elements and on an underside of said connecting elements, and the other end of said support pillar elements is formed with a second type of connecting means adapted to engage with a corresponding second-type of connecting portion that is formed on an upperside of said floor defining elements and on an upperside of said connecting elements.

In one embodiment said first-type connecting means comprises the recesses formed in the surface of said support elements and said first-type of connecting means comprises a plurality of corresponding engaging lugs formed on the underside of said floor defining elements and said connecting elements and being adapted to be received in said recesses. In this embodiment said second-type of connecting means comprises a connecting adaptor which comprises on one side a plurality of prongs disposed in a circular array and so sized and spaced as to be receivable in said recesses, and on the other side a pair of connecting legs adapted to be received within corresponding recesses formed on said floor defining elements and said connecting elements.

The partition elements may take a number of forms. In their simplest form they may simply comprise a rectangular sheet which when located in the recesses of two adjacent support pillar elements will represent a wall, but other partition elements may be provided with structural features such as a window or a door. The building construction kit of the present invention is preferably made of plastics material but other materials are possible, and in particular the partition elements may be made of cardboard to allow them to be easily adapted by a child for a particular purpose, such as the cutting of windows or the application of printing or any desired decorative effect.

It will be understood that an important aspect of the present invention is that the floor defining elements may be connected together to form a rigid planar structure. This is facilitated by the chosen connecting means which is itself considered to be an important part of the present invention in its own right.

Accordingly the present invention also extends to a connecting system for connecting together two elements in a modular construction assembly, wherein a first said element is formed with a connecting lug and a second said element is formed with a connecting recess, said connecting lug comprising a first portion extending at right angles from a side wall of said first element and a second portion extending generally parallel to said side wall and spaced therefrom by a distance equal to or slightly less than the thickness of a wall of said connecting recess of said second element whereby said connecting recess wall may be held between said second portion of said connecting lug and said side wall of said first element.

In a preferred arrangement the second portion of the connecting lug may be formed so as to curve slightly towards the side wall of the first said element so as to enhance the secure engagement of the wall of the connecting recess.

Preferably the connecting lug may be T-shaped with a said first portion extending at right angles to the side wall and two said second portions extending in opposite directions to each other. It is also preferred to form on said T-shaped lug, at the junction of said first and second portions, a channel which engages with a corresponding ridge formed as a part of said connecting recess when said connecting T-shaped lug is received within said connecting recess.

According to the present invention there is also provided a toy building construction kit, comprising: a plurality of support pillar elements, and a plurality of interconnecting elements for connecting together said pillar elements, wherein said interconnecting elements comprise first interconnecting elements that interconnect two pillar elements in a direction at right angles to the axes of said pillar elements, and second interconnecting elements that are angled relative to the axes of two said pillar elements.

BRIEF DESCRIPTION OF THE DRAWINGS

An embodiment of the invention will now be described by way of example and with reference to the accompanying drawings, in which:

FIG. 29 is a plan view of one type of partition element, FIG. 30 is an end view of the element of FIG. 29, FIG. 31 is a sectional view along line 31—31 of the element of FIG. 29, FIG. 32 is a plan view of another type of partition element, FIG. 33 is an end view of the element of FIG. 32, FIG. 34 is a sectional view along line 34—34 of the element of FIG. 32.

DETAILED DESCRIPTION OF PREFERRED EMBODIMENT

Figure 4:
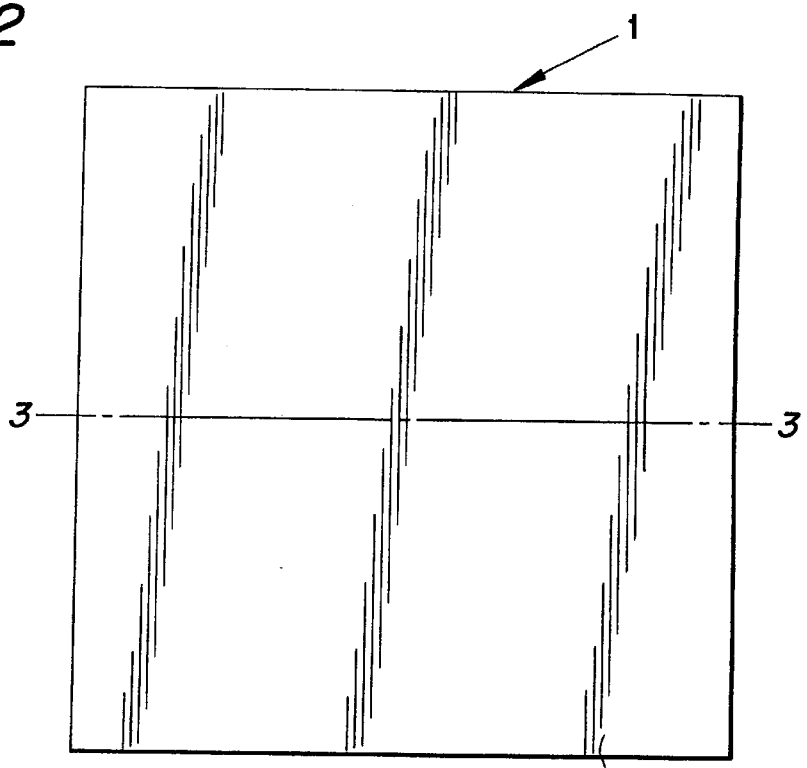
FIG. 4 is a plan view of the upperside of the element of FIG. 1.
Figure 2:
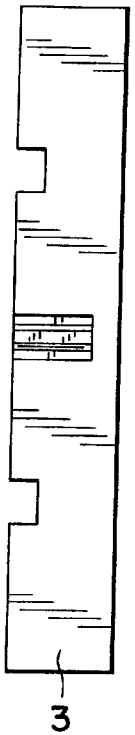
FIG. 2 is a side view of the element of FIG. 1.
Figure 1:
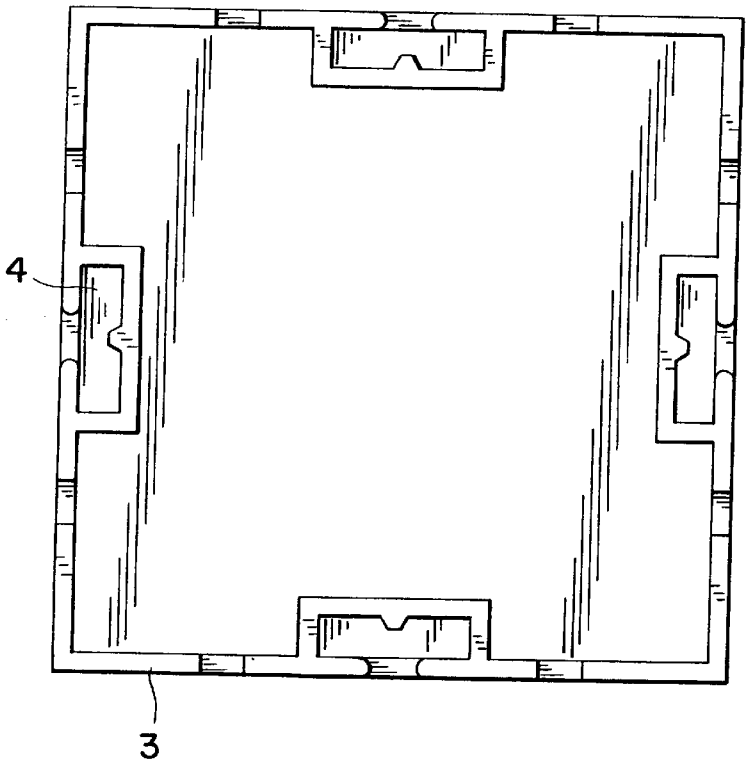
FIG. 1 is a plan view of the underside of a square floor defining element.
Figure 3:
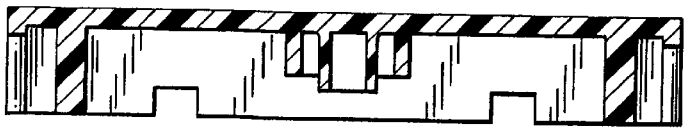
FIG. 3 is a sectional view along line 3—3 of the element of FIG. 1.
Figure 6:
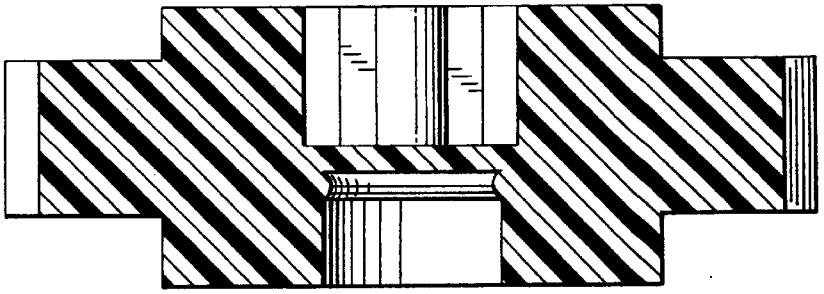
FIG. 6 is a sectional view along line 6—6 of the element of FIG. 5.
Figure 5:
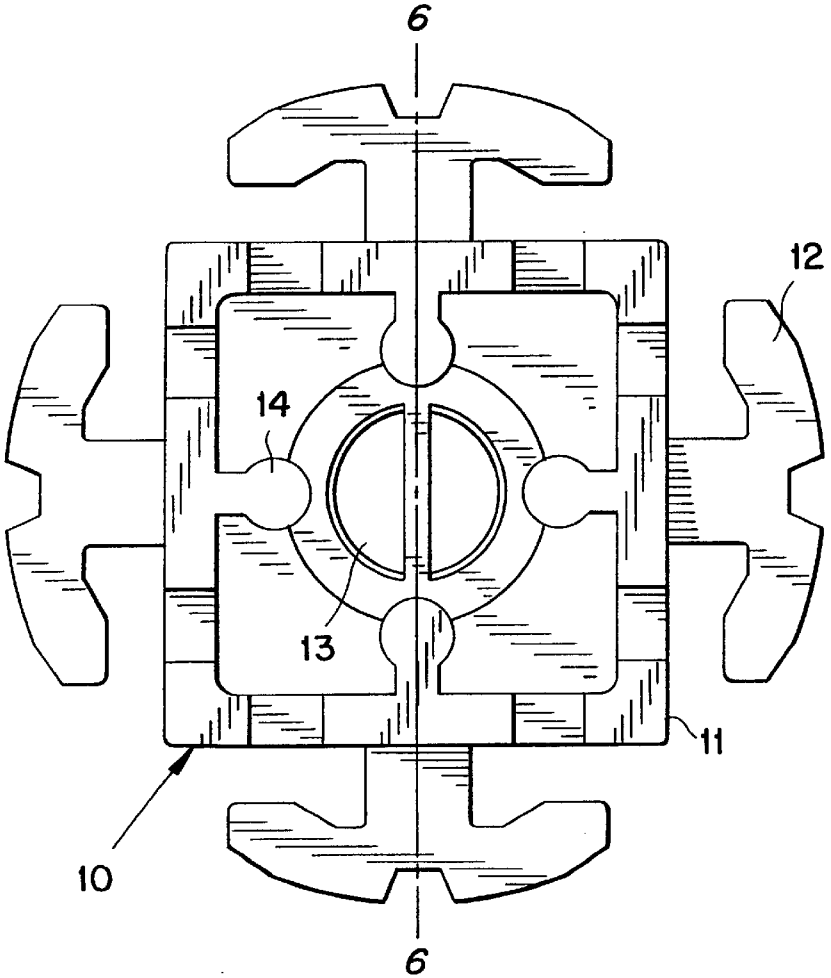
FIG. 5 is a plan view of the underside of a first-type of connecting element.
Figure 7:
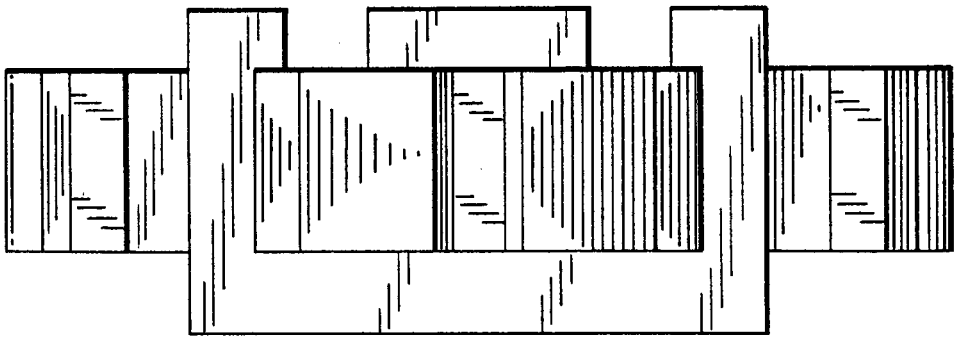
FIG. 7 is a side view of the element of FIG. 5.
Figure 8:
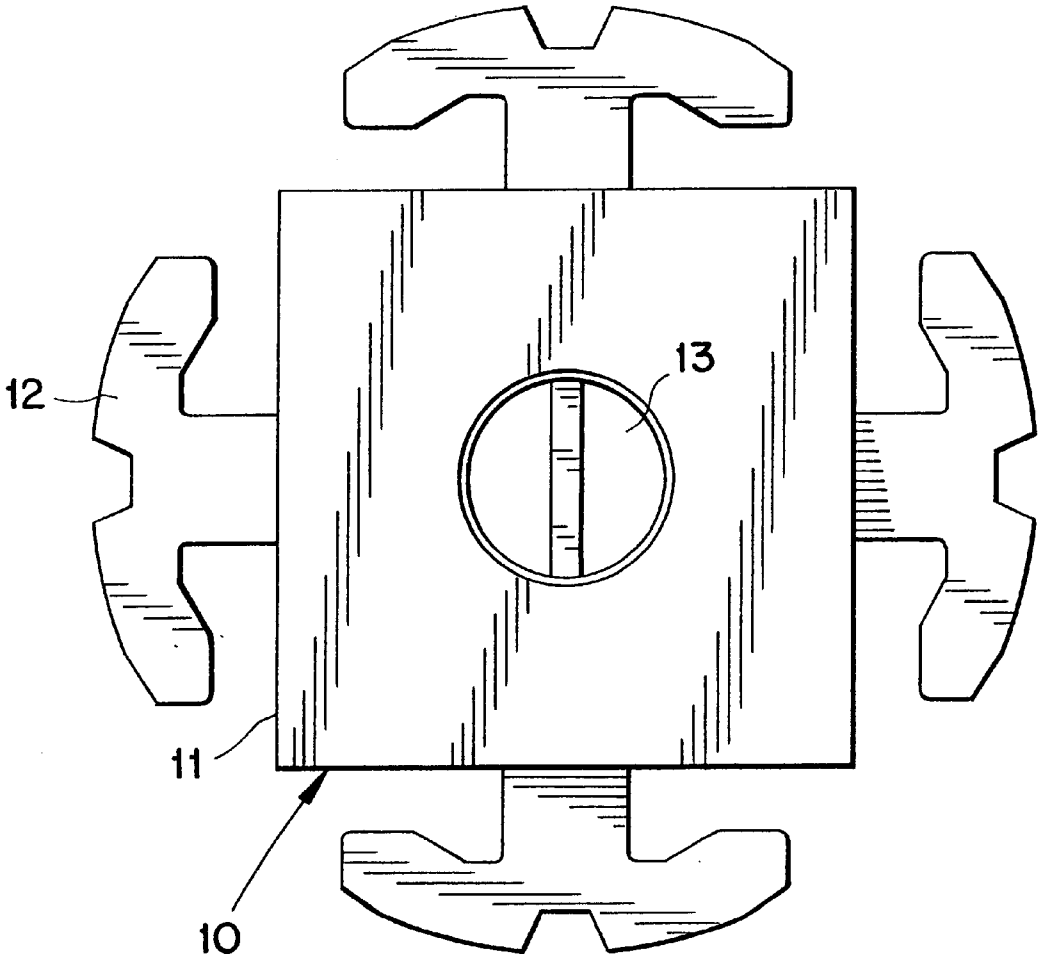
FIG. 8 is a plan view of the upperside of the element of FIG. 5.
Figures 9, 10, 11, 12:
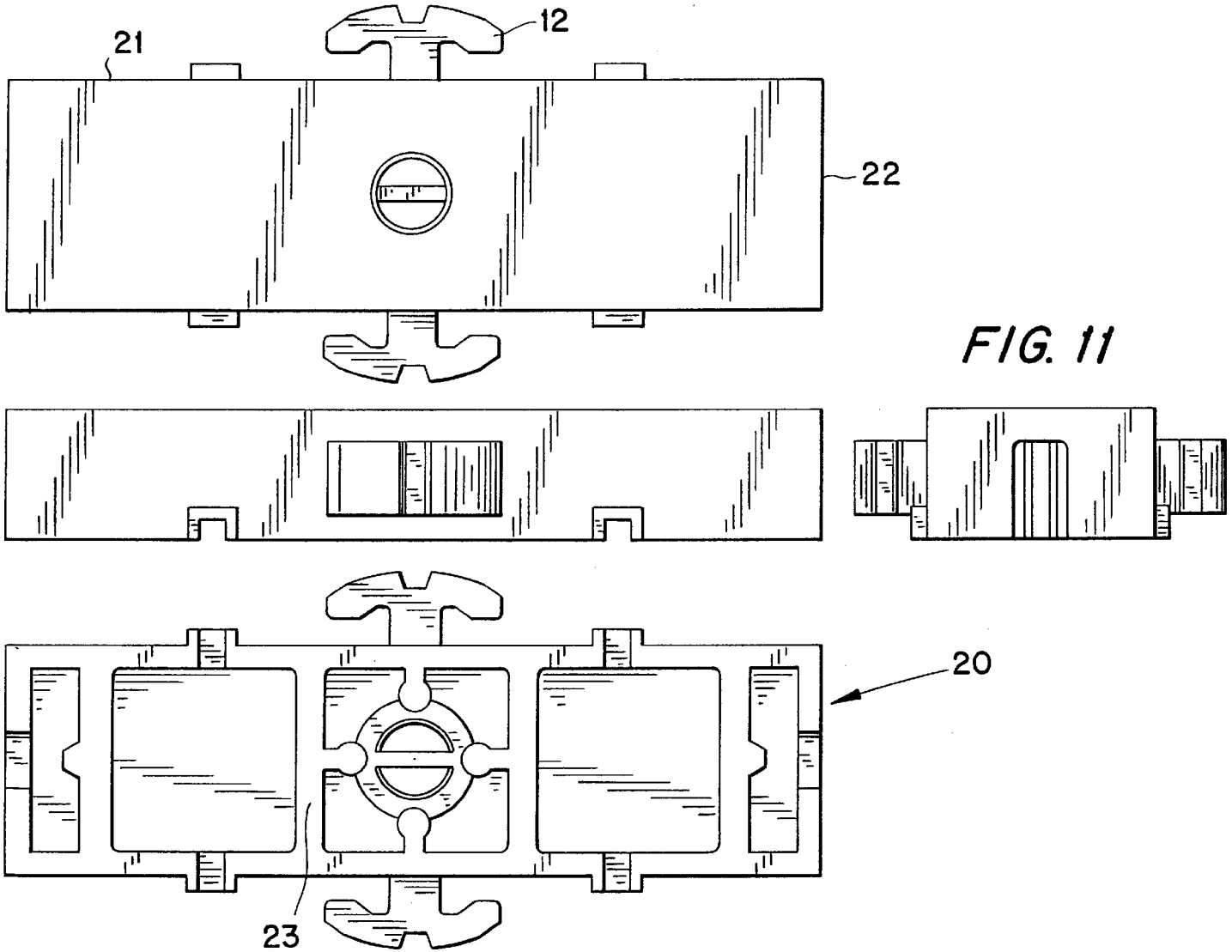
FIG. 9 is a plan view of the underside of a second-type of connecting element.
FIG. 10 is a side view of the element of FIG. 9.
FIG. 11 is an end view of the element of FIG. 9.
FIG. 12 is a plan view of the upperside of the element of FIG. 9.
Figure 16:
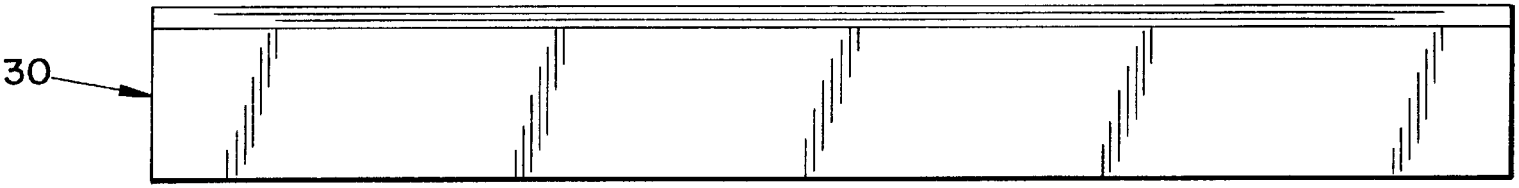
FIG. 16 is a plan view of the upperside of the element of FIG. 13.
Figure 14:
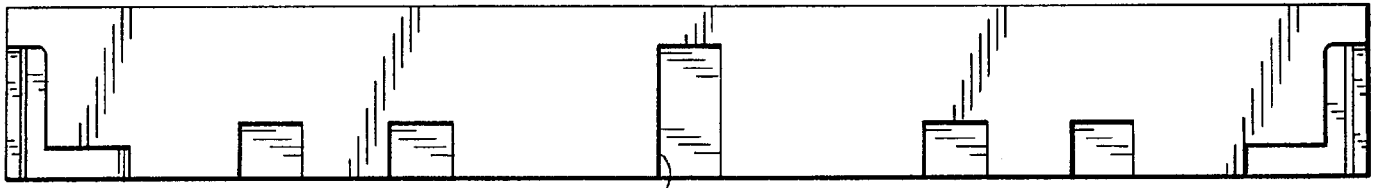
FIG. 14 is a side view of the element of FIG. 13.
Figure 13:
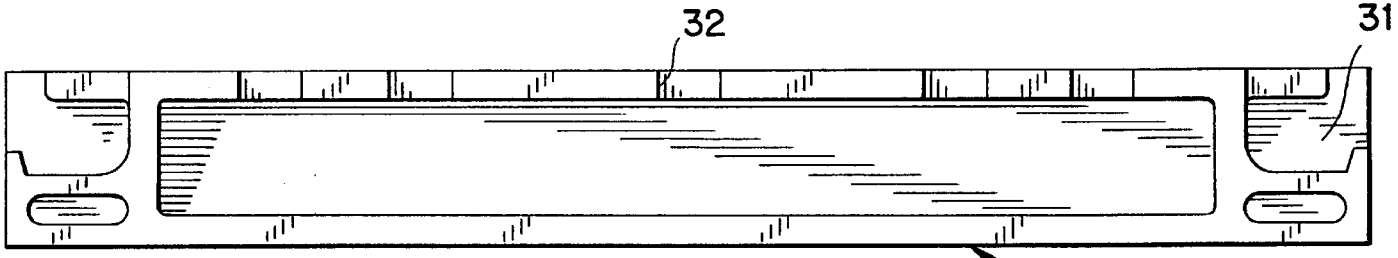
FIG. 13 is a plan view of the underside of an edge element.
Figure 15:
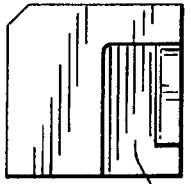
FIG. 15 is an end view of the element of FIG. 13.

Referring firstly to FIGS. 1 to 4 there is shown a generally square floor defining element 1 having a flat square upper surface 2 with four side walls 3 depending therefrom. Centrally located in the middle of each side wall 3 is a connecting recess 4 which is adapted to engage with a complementary connecting lug formed on a connecting element in a manner to be described below.

FIGS. 5 to 8 show a first-type of connecting element 10. This first-type of connecting element 10 is generally square and on each side 11 thereof is provided with a T-shaped connecting lug 12 which is adapted to engage in a connecting recess of the type provided as connecting recesses 4 on the sides of the floor defining element 1.

In the centre of the upperside of connecting element 10 is provided a connecting portion 13 for engaging one end of a support pillar element. Formed on the underside of the connecting element 10 are four inwardly directed protusions 14, one on each side, which also serve to connect the connecting element 10 to a support pillar element.

FIGS. 9 to 12 show a second-type of connecting element 20 of a generaly rectangular shape. In addition to the difference in shape, second-type connecting element 20 differs from the first-type 10 in that while the first type is provided with four connecting lugs, the second-type 20 is formed with both connecting lugs and connecting recesses. A connecting lug 12 is formed centrally on each long side wall 21 of the second-type connecting element 20, and a corresponding connecting recess 4 is formed at each end 22 of the second-type connecting element 20. The upperside of the second-type connecting element 20 is also formed with a connecting portion 13 for engaging a support pillar element, and similar to first-type connecting element 10 the underside of the second-type connecting element 20 is formed at a central location thereof with four inwardly directed protusions 14, two extending from the long side walls 21 at locations corresponding to the connecting lugs, and two extending toward each other from two cross web members 23 extending between the side walls 21.

FIGS. 13 to 16 show a side defining element 30 of a generaly elongate form. At each end the side defining element is formed with a connecting half-recess 31 corresponding to one half of a connecting recess 4. At a central location along one side of the side defining element 30 there is formed a connecting lug receiving aperture 32.

Figure 17:
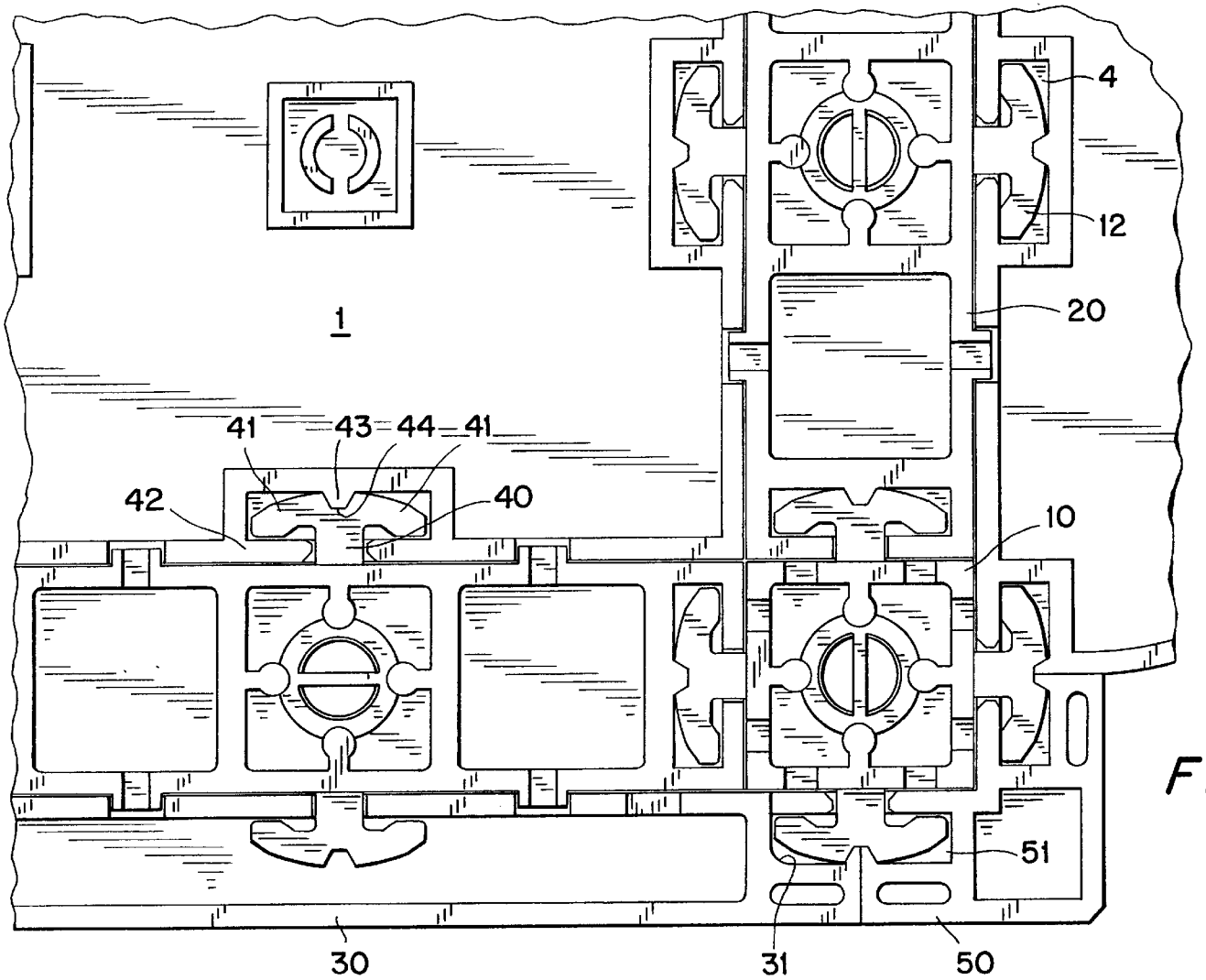
FIG. 17 is a view of the undersides of several different kinds of element showing how they interconnect with each other.

FIG. 17 shows how these various types of elements may be connected together. Notably the connecting lugs formed on the first and second-type connecting elements may be received within the corresponding connecting recesses formed on the second-type connecting elements and the floor defining elements. In particular the interconnection of the connecting lugs and recesses can be seen particularly clearly in FIG. 17.

Each connecting lug 12 comprises a T-shaped lug having a first portion 40 extending outwardly from a side wall of the connecting element. Spaced from the side wall of the connecting element are two second portions 41 which are symmetrical with respect to each other and the first portion 40 and which join the first portion 40 at the end of the first portion 40 remote from the side wall. The two second portions 41 curve slightly towards the side wall of the connecting element and are spaced from the side wall of the connecting element by a distance that is equal to or possibly slightly less than the thickness of the wall 42 of the connecting recess 4 into which the connecting lug is to be received.

The connecting lug 12 is received in a corresponding connecting recess 4 of a rectangular shape and in size generally corresponding to the dimensions of the connecting lug 12. This close dimensioning of the lug 12 and the aperture 4, and in particular the spacing of the ends of the second portions 41 from the side wall of the connecting element from which the lug extends, together with the resilient nature of the plastics material from which the connecting elements are made, ensures that when a connecting lug 12 is received within a corresponding connecting recess 4 the two elements bearing the lug and recess respectively are firmly connected together. To enhance the strength of this connection still further, the interior of the connecting recess 4 may be provided with a locking ridge 43 that engages in a locking channel 44 formed on the T-shaped connecting lug 12 at the junction of the first 40 and second 41 portions thereof.

This method of connecting lugs in recesses applies whichever two elements are connected, be they first and second-type connecting elements, or a second-type connecting element and a floor defining element. The same principles also apply when other types of element are being interconnected, for example side defining elements 30 and corner defining elements 50 that are formed with half-recesses 31, 51. Half-recesses 31,51 are dimensioned and shaped so as to receive one second portion 41 of a connecting lug 12 and that single portion within a half-recess is sufficient to provide a strong connection.

Figure 18:
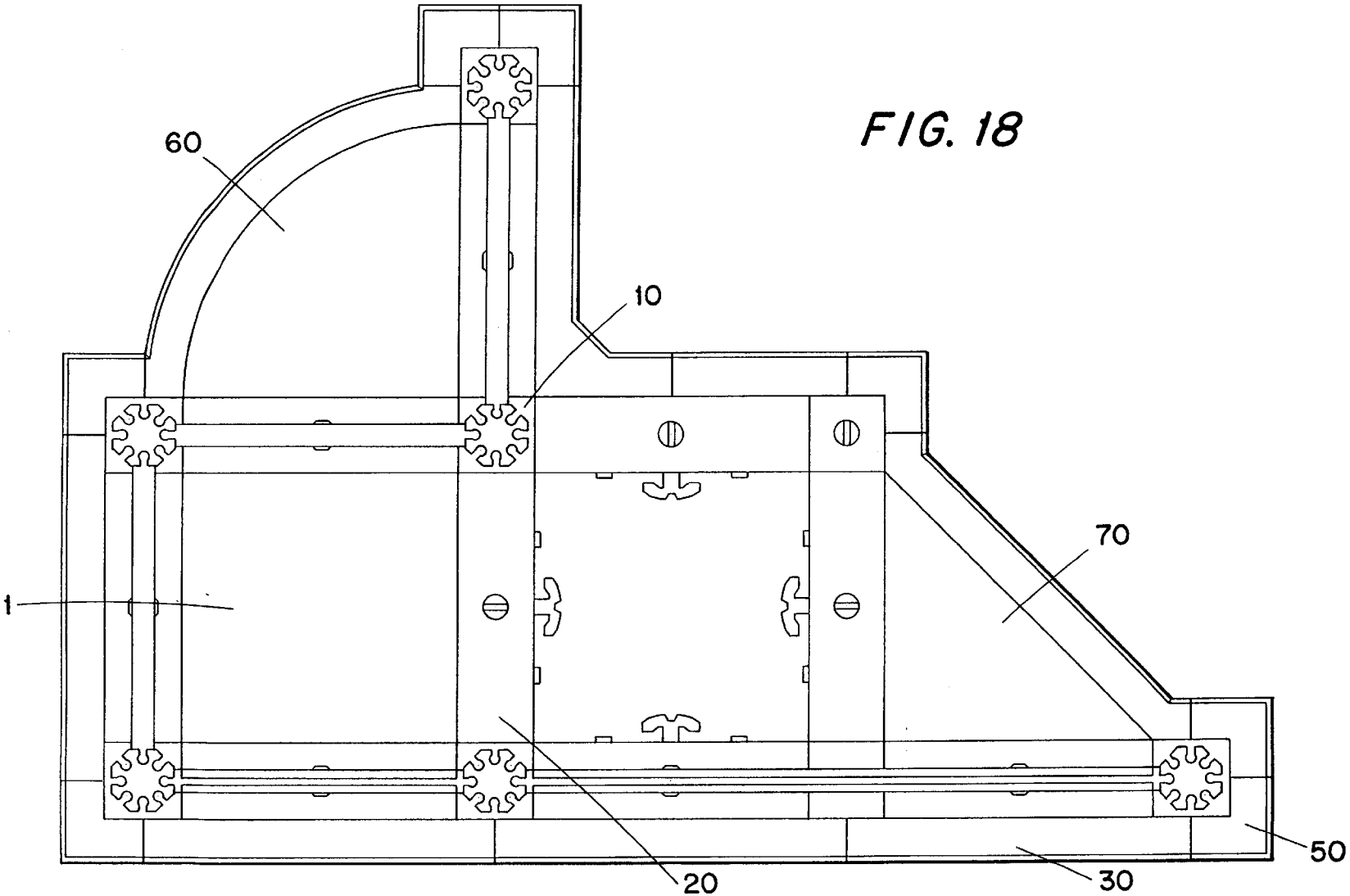
FIG. 18 is a view of the top upper surface of the floor of a toy building as constructed from the present invention.
Figure 19:
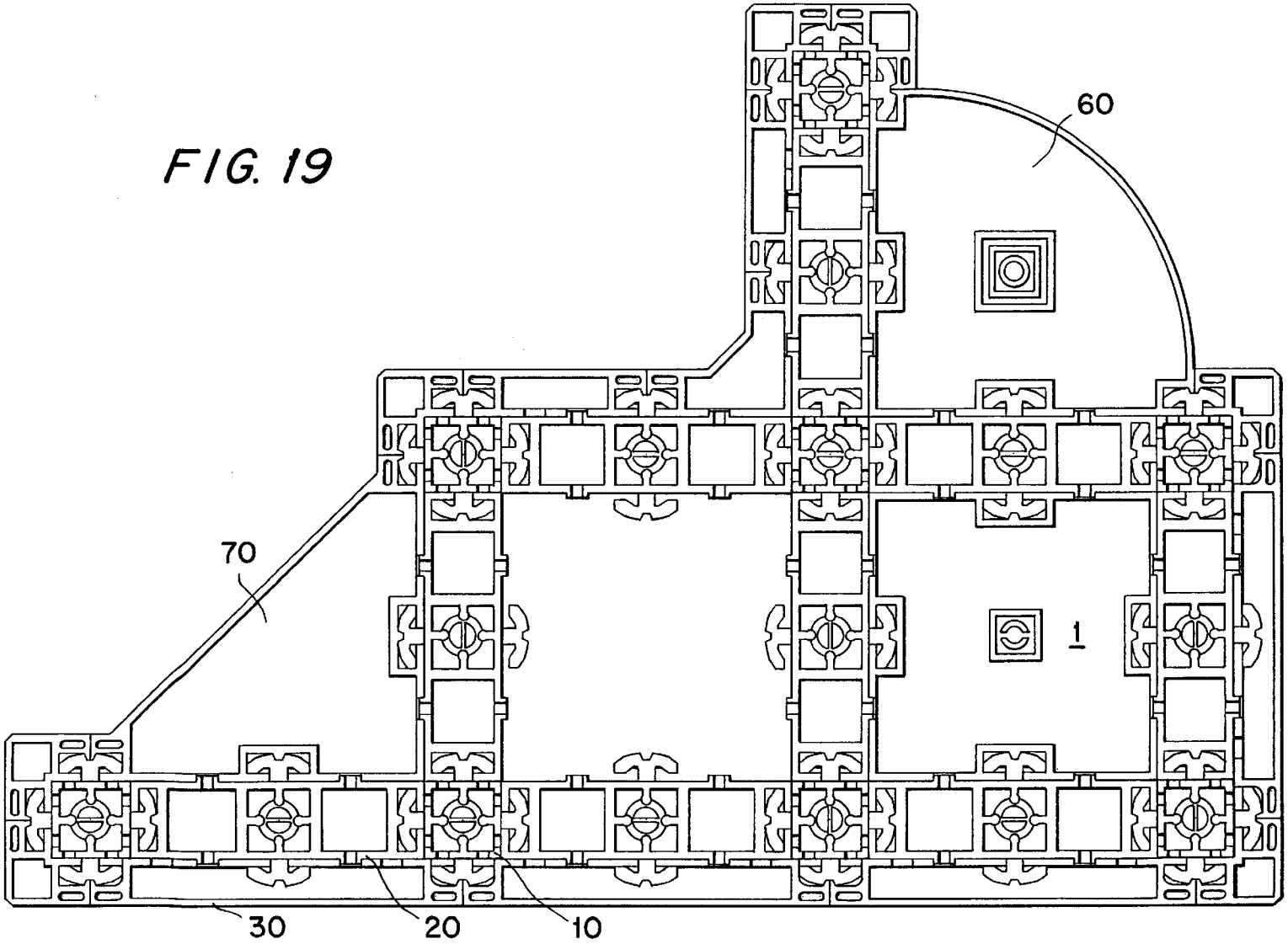
FIG. 19 is a view of the under surface of the floor of FIG. 18.

FIGS. 18 and 19 show how the various elements previously described, together with some further types of elements if desired, may be interconnected in the manner described to form one floor of a toy building, the shape, dimensions and layout of which may be chosen by a child. A rectangular lattice of second-type connecting elements is formed with these second-type connecting elements being connected at their junctions by first-type connecting elements. The squares defined by four such interconnected second-type connecting elements are occupied by the square floor defining elements. Other spaces, particularly those at corners and edges not completely bounded, may be occupied by any chosen type of element. Possibilities include elements in the form of a segment of a circle 60, or triangular elements 70.

The sides of the floor are defined by fitting side defining elements 30 to any free connecting lugs 12 and corner defining elements are fitted at all corners.

Figure 21:
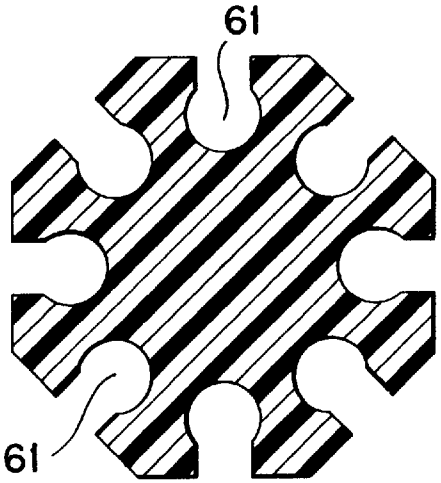
FIG. 21 is a sectional view along line 21—21 of the element of FIG. 20.
Figure 20:
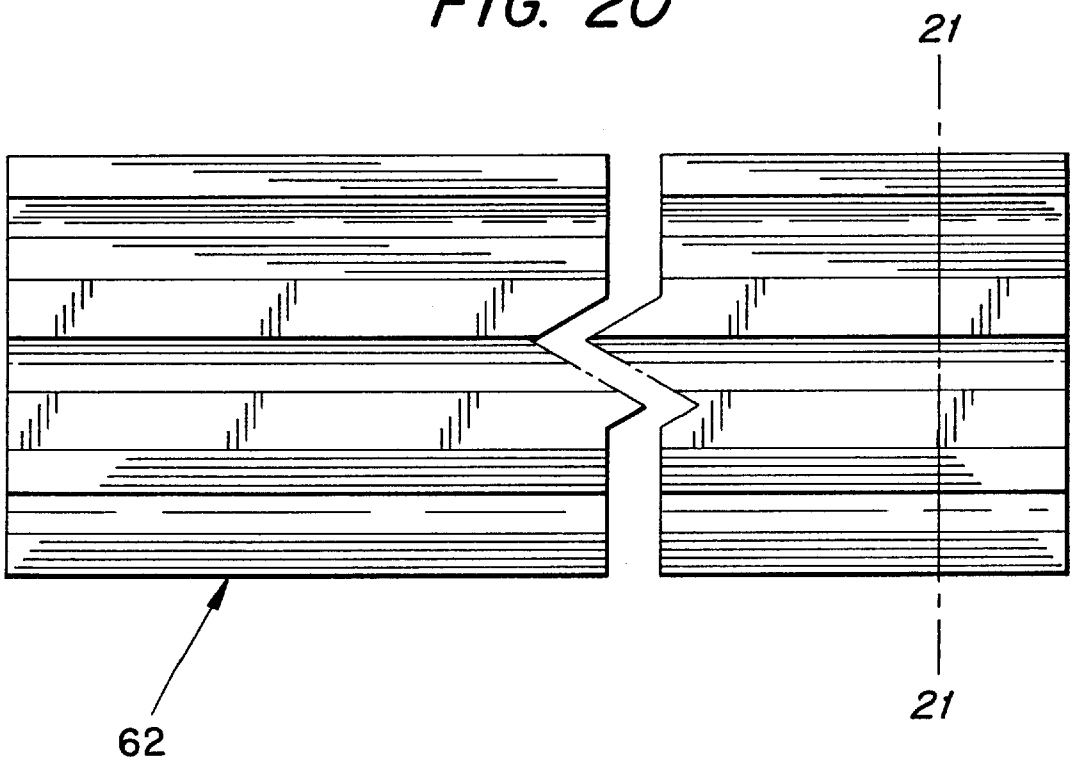
FIG. 20 is a side view of a support pillar element.
Figure 24:
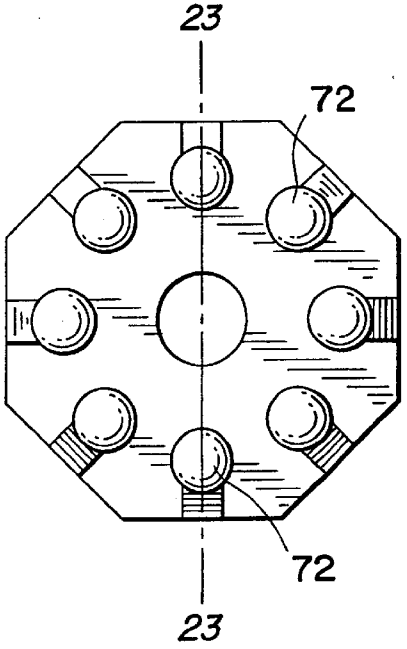
FIG. 24 is a view from one end of the adaptor of FIG. 22.
Figure 23:
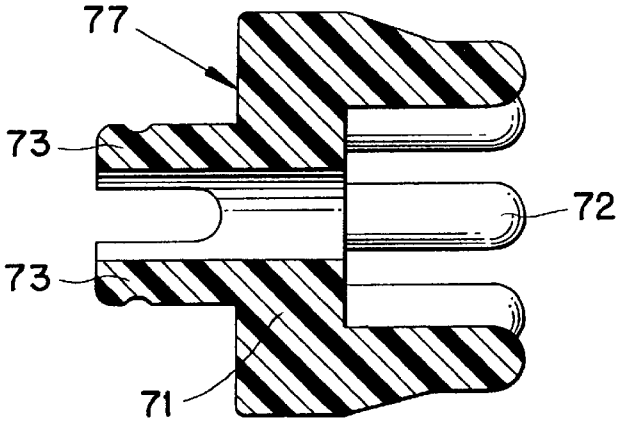
FIG. 23 is a sectional view along line 23—23 of the adadptor of FIG. 24.
Figure 22:
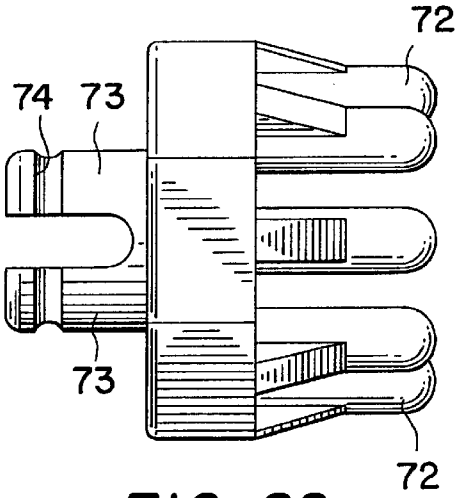
FIG. 22 is a side view of a connecting adaptor for a support pillar element.
Figure 25:
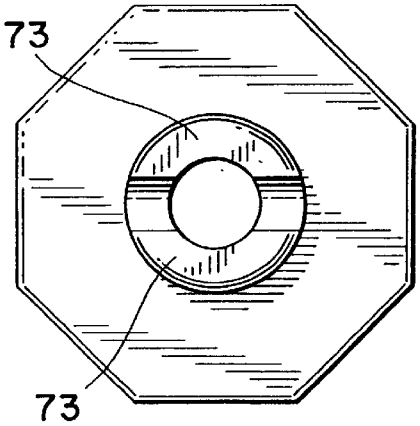
FIG. 25 is a view from the other end of the adaptor of FIG. 22.

The elements so far described allow a child to design and construct a floor of a toy building in two dimensions. It is an important aspect of the present invention, however, that the toy construction kit allows a child to create a toy building in three dimensions with a number of storeys. Accordingly the construction kit also includes a plurality of support pillar elements that allow different floors to be interconnected so as to enable a three-dimensional structure to be created. FIGS. 20 & 21 illustrate such a support pillar element 62.

Support pillar element 62 is generally cylindrical and of a desired length. As shown in cross-section the support pillar element 62 has a polygonal cross-section, in this case octagonal, but each face of the polygon is formed with a recess 61 extending along the complete axial length of the support pillar element 62. In cross-section the shape of the recesses 61 are complementary to the protusions 14 formed on the undersides of first- and second-type connecting elements. Thus one end of the support pillar element 62 can engage the underside of a first- or second-type connecting element by means of engagement of protusions 14 in recesses 61.

The connection of the other end of a support pillar element 62 to the upperside of a floor defining element or to the upperside of a first- or second-type connecting element is by way of an adaptor 77 as shown in FIGS. 22 to 25. Adaptor 77 comprises a main body portion 71, eight prongs 72 arranged in a circular array and directed in one direction from the main body portion 71, and two arcuate connecting legs 73 extending from the main body portion 71 in the opposite direction from the prongs 72. The prongs 72 are spaced apart from each other and dimensioned such that they may be received in the recesses 61 formed in the sides of the support pillar element 62 and thus the adaptor 77 may be fitted to one end of the support pillar element 62.

Figure 26:
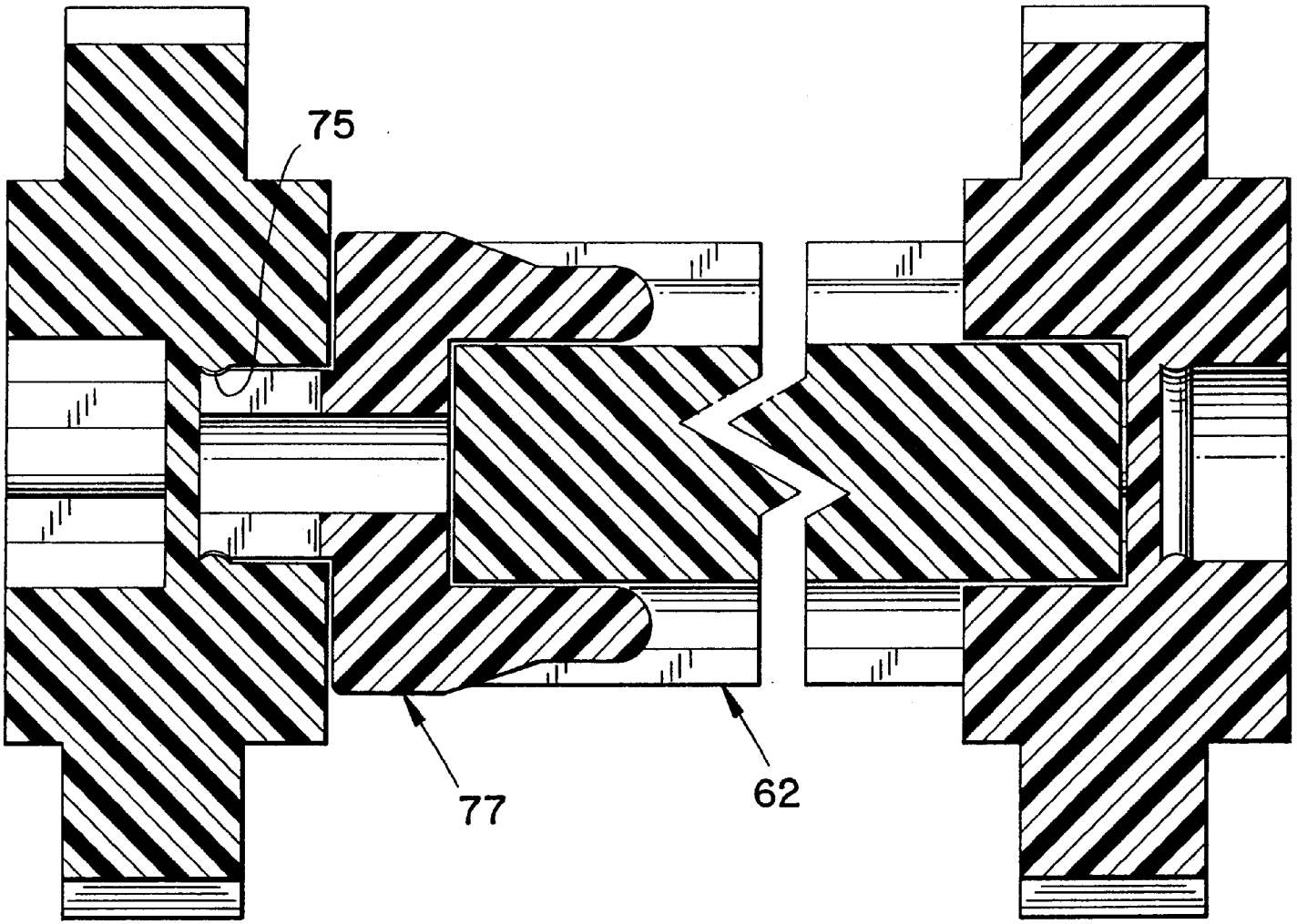
FIG. 26 illustrates how the support pillar element of FIGS. 20 & 21 may be connected to a first-type of connecting element.

The arcuate connecting legs 73 are sized so as to be receivable within correspondingly shaped apertures or recesses formed in the uppersides of the floor defining elements, and the uppersides of the first- and second-type connecting elements. To facilitate secure engagement of the connecting legs 73 in the apertures or recesses the ends of the connecting legs 73 may be provided with a recessed channel 74 which engages a corresponding annular ridge 75 formed in the aperture or recess into which the connecting legs 73 are fitted. A firm connection is also facilitated by the resilient nature of the plastics material of which the adaptor is made, if desired the legs 73 may be spaced apart slightly greater than the spacing of the apertures or recesses into which they are inserted. FIG. 26 shows a support pillar element 62 fitted with an adaptor 77 and with the connecting legs 73 of the adaptor received within recesses formed in a connecting element. The other end of the support pillar element 62 in FIG. 26 is received in the other side of a connecting element in the manner previously described with protusions 14 engaging in recesses 61.

The support pillar elements 62 allow two floors to be interconnected and allow vertical structures to be generated. In addition a staircase element may be provided formed with a connecting T-shaped lug at each end so as to allow it to connect with corresponding recesses formed in the elements defining two adjacent floors.

Figure 27:
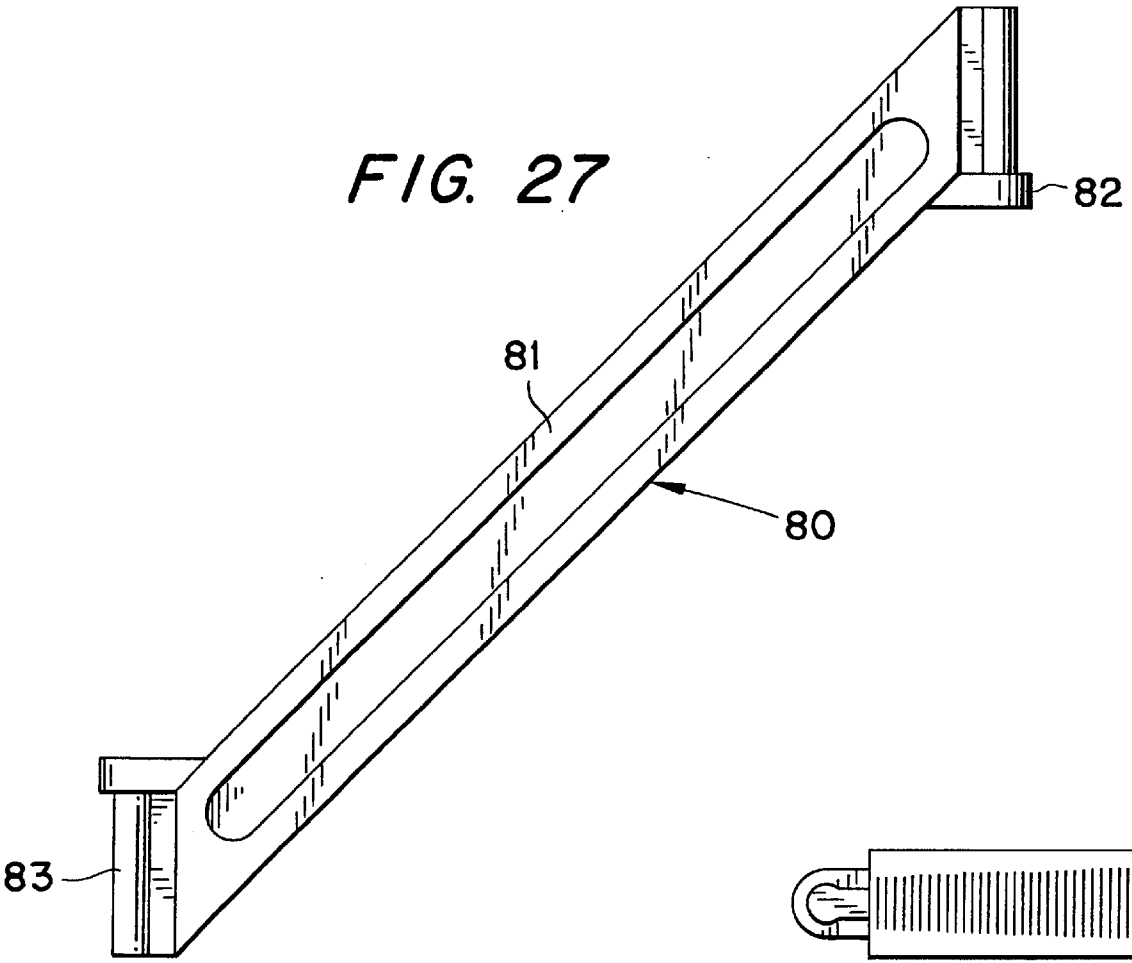
FIG. 27 is a side view of a strut element.
Figure 28:
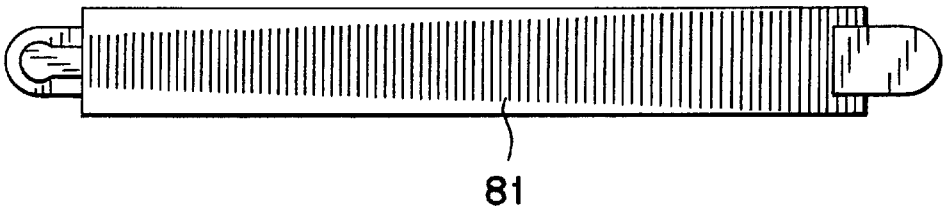
FIG. 28 is a plan view of the element of FIG. 27.

The flexibility of the system is enhanced, however, by the provision of angled strut members 80 as are shown in FIGS. 27 & 28. Such an angled strut member is formed with a central body portion 81 and upper and lower end fittings 82,83. The lower end fitting 82 is designed to engage with the top of a support pillar element, and the upper end fitting 83 is adapted to engage the top of a support pillar element. The use of such angled strut members allows still more complex structures to be created.

FIGS. 29 to 31 illustrate a first form of partition element 80. Partition element 80 comprises a planar rectangular partition portion 81 provided along two sides thereof with connecting members 82 having a cross-section complementary to that of the recesses 61 formed in the surfaces of the support pillar elements 62. Connecting members 82 do not extend for the full length of the sides of the partition element so that they do not cause an obstruction at the junctions between the support pillar elements and the floor defining elements and/or connecting elements.

FIGS. 32 to 34 illustrate an alternative form of partion element 80' which differs from that shown in FIGS. 29 to 31 in that is provided with a window opening 83. It will be understood that other forms of partition element are also possible, for example such elements may be formed with a door.

Figure 35:
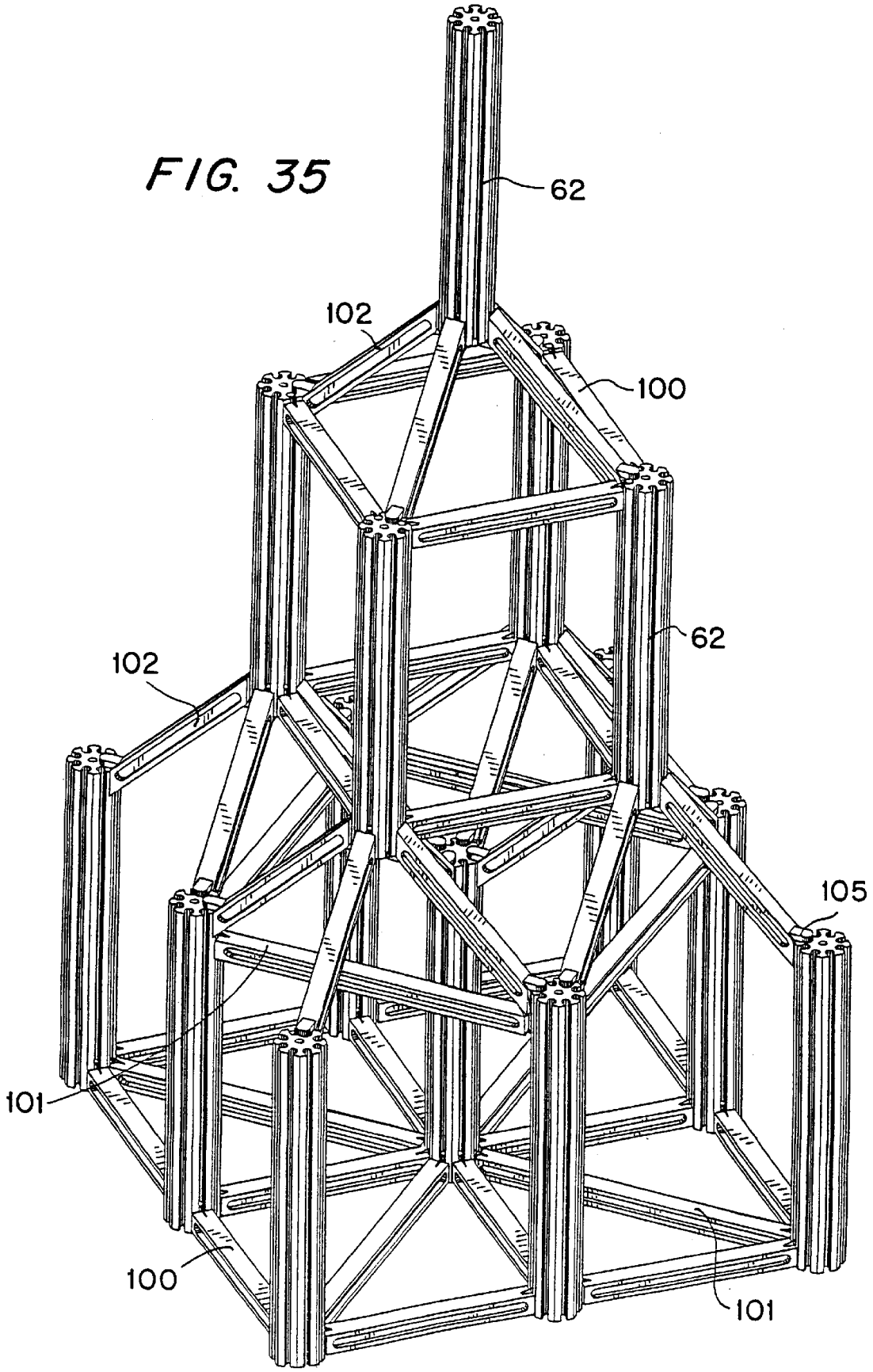
FIG. 35 is a perspective view of an alternative embodiment.

FIG. 35 illustrates an alternative embodiment of the invention. In this embodiment a building kit is provided in which the floor defining elements and the partition elements are not employed. Instead a lattice framework structure may be created that is constructed from the support pillar elements 62 interconnected by interconnecting elements 100, 101,102. There are three types on interconnecting element. The pillar elements are arranged in a rectangular array and a first type of interconnecting element 100 comprises a side interconnecting element for connecting two support pillar elements along a side of a square or rectangle defined by the support pillar elements. A second type 101 interconnects two support pillar elements 62 across a diagonal. Types 100 and 101 connect pillars laterally with respect to the axis of the pillar. Type 100 may be sufficient on its own, but the addition of the diagonal type 101 provides added strength to the completed structure. A third type 102 corresponds to the angled strut member 80 described with reference to FIGS. 27 & 28 and allows support pillars 62 in different levels to be connected. Type 102 interconnects two pillar elements in a direction at an angle relative to their axes. All these different interconnecting elements connect with a support pillar element by being formed at their ends with lugs 105 that engage in the recesses formed on the surface of the support pillar elements. FIG. 35 shows how these various elements may be interconnected to form very strong and stable structures.

I claim:

1. A toy building construction kit, comprising:

(a) a plurality of generally planar modular floor defining elements;

(b) means for interconnecting said floor defining elements to create a floor, said interconnecting means comprising connecting elements formed with connecting lugs adapted to engage in use with corresponding connecting recesses formed in said floor defining elements, wherein each of said connecting lugs is T-shaped and comprises a first portion extending at right angles from a side wall of a said connecting element and a second portion extending generally parallel to said side wall, said second portion having first and second free ends spaced from said side wall by a distance slightly less than the thickness of a wall of said connecting recess of said floor defining element, whereby said connecting recess wall may be held between said second portion of said connecting lug and said side wall of said connecting element;

(c) a plurality of support pillar elements adapted to be secured between two adjacent floors, said support pillar elements comprising generally cylindrical elements of polygonal cross-section with an elongated recess formed in each surface thereof with the dimensions of said elongated recesses being such that an edge of a partition element may be received therein, said pillar elements also comprising connecting means whereby said pillar elements may connect with corresponding connecting portions formed on said floor defining elements and said connecting elements, wherein one end of each said support pillar element is formed with a first type of connecting portion that is formed on an underside of said floor defining elements and on an underside of said connecting elements, and the other end of each said support pillar element is formed with a second-type of connecting portion that is formed on an upperside of said floor defining elements and on an upperside of said connecting elements; and (d) a plurality of partition elements, said partition elements being adapted to be received between pairs of said support pillar elements to define walls, wherein said first-type of connecting means comprises said recesses formed in the surfaces of said support pillar elements and said first-type of connecting portion comprises a plurality of engaging lugs formed on an underside of said floor defining elements and said connecting elements and being adapted to be received in said recesses formed in the surfaces of said pillar support elements.

2. A construction kit as claimed in claim 1, wherein one end of each said support pillar element is formed with a first-type of connecting means adapted to engage with a corresponding first-type of connecting portion that is formed on an underside of said floor defining elements and on an underside of said connecting elements, and wherein the other end of each said support pillar element is formed with a second-type of connecting means adapted to engage with a corresponding second-type of connecting portion that is formed on an upperside of said floor defining elements and on an upperside of said connecting elements.

3. A construction kit as claimed in claim 1, wherein said second-type of connecting means comprises a connecting adaptor which comprises on one side a plurality of prongs disposed in a circular array and so sized and spaced as to be receivable in said elongate recesses, and on the other side a pair of connecting legs adapted to be received within said second-type connecting portions comprising corresponding recesses formed on said floor defining elements and on said connecting elements.

4. A connecting system for connecting together two elements in a modular construction assembly, wherein a first of said elements is formed with a T-shaped connecting lug and a second of said elements is formed with a connecting recess, said connecting lug comprising a first portion extending at right angles from a side wall of said first element and a second portion extending generally parallel to said side wall and an endmost portion configured toward said sidewall, said second portion having first and second free ends that are thereby spaced from said side wall by a distance slightly less than a thickness of a wall of said connecting recess of said second element, whereby said connecting recess wall may be held between said second portion of said connecting lug and said side wall of said first element.

5. A connecting system as claimed in claim 4, wherein said second portion of said connecting lug curves slightly towards the side wall of said first element.

6. A connecting system as claimed in claim 4, wherein at the junction of said first and second portions said connecting lug is formed with a locking channel, and said connecting recess is formed with a corresponding locking ridge adapted to engage in said locking channel when said connecting lug is received within said connecting recess.

7. A connecting system as claimed in claim 4 wherein a thickness of said second portion is less than a width of said connecting recess, and wherein the distance between a point on said second portion furthest away from said side wall and said free ends in a direction perpendicular to said side wall is slightly greater than the width of said connecting recess.

8. A connecting system as claimed in claim 4 wherein the free ends of said second portion are formed with flat surfaces that are parallel to a surface of said side wall.

* * * * *